United States Patent [19]

Huber et al.

[11] 4,437,610

[45] Mar. 20, 1984

[54] REVERSIBLE QUICK CHANGE NOZZLE HOLDER FOR SPRAY GUNS

[75] Inventors: Willi Huber; Manfred Metz, both of Altstätten, Switzerland

[73] Assignee: J. Wagner AG, Altstäten, Switzerland

[21] Appl. No.: 327,568

[22] Filed: Dec. 4, 1981

[30] Foreign Application Priority Data

Dec. 10, 1980 [DE] Fed. Rep. of Germany ..... 3046464

[51] Int. Cl.[3] ..... B05B 15/02

[52] U.S. Cl. ..... 239/119; 239/392; 239/600

[58] Field of Search ..... 239/119, 288–288.5, 239/390–392, 525–526, 600

[56] References Cited

U.S. PATENT DOCUMENTS

| | | | |
|---|---|---|---|
| 3,447,755 | 6/1969 | Cartwright | 239/600 X |
| 3,516,611 | 6/1970 | Piggott | 239/391 |
| 3,563,463 | 2/1971 | Walker | 239/119 |
| 3,955,763 | 5/1976 | Pyle et al. | 239/119 |
| 4,074,857 | 2/1978 | Calder | 239/119 |
| 4,165,836 | 8/1979 | Eull | 239/119 |
| 4,256,260 | 3/1981 | Piggott | 239/119 |

FOREIGN PATENT DOCUMENTS 2622396 12/1976 Fed. Rep. of Germany .

*Primary Examiner*—Andres Kashnikow

*Attorney, Agent, or Firm*—Hill, Van Santen, Steadman & Simpson

[57] ABSTRACT

A reversible and quick change nozzle holding tip assembly for spray guns is provided with a base member for attachment to the outlet end of the spray gun which rotatably mounts an adapter piece. A gasket member extends from the outlet end of the spray gun through the base member and adapter piece into contact with a nozzle mount holding a nozzle in a recess in the adapter piece. The nozzle mount is contained in a nozzle mount holder having a bridge portion projecting radially outwardly of the adapter and terminating in a second nozzle mount containing a second nozzle. The nozzle mount holder is both reversible to invert a given nozzle and invertible to insert the second nozzle. A clamping or cover nut includes a quick lock thread mesh with the adapter piece to clamp the nozzle mount in position in the adapter piece in engagement with the gasket.

27 Claims, 6 Drawing Figures

REVERSIBLE QUICK CHANGE NOZZLE HOLDER FOR SPRAY GUNS

BACKGROUND OF THE INVENTION

This invention relates to spraying devices and more particularly to mechanisms for affixing a spray tip or nozzle to the end of a spray gun in a manner allowing the nozzle to be reversed for dislodgement of blockage.

Prior Art

Despite prefiltration of material to be sprayed through a spray nozzle of spray gun, such as paint, such nozzle tips frequently become blocked, either due to presence of pigment build-up at the nozzle or due to the use of quick curing paints. In order to allow quick unblockage of the nozzle tip, which may have very small orifice, devices have been suggested which allow the nozzle to be rotated 180° within its holder, so as to allow a back-flush of liquid from the spray gun to clean the nozzle by a reverse flow. Due to the high pressure of the liquid exiting the spray gun valve, the paint or other agent being sprayed will rinse out a reversed nozzle tip quickly with a minimal wastage of sprayed liquid. Such devices are shown, for example, in U.S. Pat. Nos. 3,116,882, 3,202,360 and 3,831,862.

Such prior suggested reversible tips have proved themselves advantageous in the painting industry, but the known designs have various disadvantages. Principally the known designs lack great versatility, and in many instances provide for change of the nozzle tip only with difficulty requiring expenditure of significant time and a high degree of assembly dexterity. Frequently in spraying, and particularly in paint spraying, it is desired to change the nozzle size or shape to either produce a different spray pattern or to accomodate a change in the characteristics of the liquid being sprayed.

In devices of the type illustrated in U.S. Pat. No. 3,116,882 and U.S. Pat. No. 3,202,360, nozzle tip is contained in a turret arrangement which is rotatably inserted into a housing secured to the spray gun. Generally the devices include spherical or cylindrically designed rotatable members which have the nozzle tip affixed therein. Such rotatable members can be rotated about an axis which is perpendicular to the flow direction by means of an external lever. In such devices cleaning of the nozzle tip can be relatively easily accomplished by mere rotation of the nozzle holding member. However, in such devices nozzle tip change, for example, to accomodate a different spray pattern or different fluid, is more difficult. Although U.S. Pat. No. 3,116,882 discloses embodiments having more than one nozzle in the rotatable member, exchange of nozzle holding members is not easily provided.

The device illustrated in U.S. Pat. No. 3,831,862 requires the use of a specially designed nozzle tip formed as a cylindrical member having a radially projecting pin which is guided in a bayonet-type quick change groove in a holder member affixed to the spray gun. In this type of device, the nozzle can be inverted by removing the nozzle holder, reversing it and reinserting it into the housing member affixed to the gun. While this device simplifies the exchangability of nozzles, it requires the usage of specially constructed or shaped nozzles.

It would therefore be an advance in the art to provide a single design for affixing nozzles to spray guns which would both accomodate quick reversibility of the nozzle for purposes of cleaning blockage, allow quick exchange of nozzles and allow usage of standard nozzle forms.

SUMMARY OF THE INVENTION

It is therefore the principal object of this invention to create a nozzle holder assembly for spray guns which provides for easy reverse cleaning of the nozzle by the spray stream while providing for quick exchange of different nozzles without complicated disassembly or reassembly and further which is capable of utilizing standard, commercially available nozzle tips. Further, it is an object of this invention to provide such a device wherein the orientation of the spray pattern from the nozzle can be realigned easily with respect to the spray gun to allow facilitated usage of oval or fan shaped spray tips.

This basic object is achieved in this invention by use of an assembly which includes a base body rigidly connected to the outlet end of a spray gun which combines with a clamping or cover nut which connects to the base body through a quick thread, or which, in an alternative embodiment, connects to an adapter piece intermediate the base body and the clamping nut and is rotatable with respect to the base body. The base body, or the adapter piece, is provided with a recess on its axial end opposite the connection to the spray gun, the recess being axially open and adapted to receive a nozzle tip mounting a standard nozzle tip. The nozzle tip mount is in turn received in one end of a nozzle mount holder. The nozzle mount and nozzle mount holder are clampable between the base body and the clamping nut or, alternatively, the adapter piece and the clamping nut to be retained in fixed position. A gasket member is positioned between the nozzle and the spray gun extending through the base body or, respectively, the base body and adapter piece.

By use of a device according to this invention, it is not only possible to quickly turn the nozzle 180° with respect to the spray position to clean the nozzle opening with the assistance of the sprayed liquid, but, importantly, exchange of the nozzle tip is extremely simplified. All that is required to allow either reversal of the nozzle or change of the nozzle is to loosen the clamping nut thereby freeing the nozzle mount from the recess in the base body or, respectively, the recess in the adapter piece. The nozzle mount can then be removed and reinserted in reverse position or, if desired, a new nozzle mount containing a different nozzle can be easily inserted. Thus, with this construction, without having to disassemble the entire tip assembly into its individual components, reversal or exchange of the tip can be carried out in a very short time by anyone. Accordingly, setup times are correspondingly reduced. In this manner, a reversal device is provided fulfilling the above mentioned principal object; the device having both simplicity and reliability.

In a further refinement of the invention, the locking connection between the clamping nut and the base body or transition piece can utilize two or more projecting detents or projecting pins disposed uniformly over the circumference of one of the parts which are to be connected or inserted into grooves or threads provided in the other part, the threads being angular or Z-shaped in the groove longitudinal length. Thus, a quick thread connection is provided.

In order to secure the connection in the most clamped or operating position, the groove or female thread should be provided with a wall surface extending entirely or partially over the length of the final lock section which is inclined with respect to the perpendicular of the longitudinal axis at an angle which leads to self-locking. In such a system the detents or pins would be similarly equipped with an opposed surface dimensioned and angled to interact with the seating surface of the groove or female thread. A high restraining force can be achieved by such a design where both the female groove and the projecting detent have long mating inclined faces which, in the operating position, are inclined at an angle to the perpendicular to the longitudinal axis of the overall unit. In addition, if desired, mating snapsurface projections and recesses maybe provided at the fully clamped and/or intermediate positions to resist further inadvertent rotation of the clamping nut. In this manner, a secure attachment of the clamping nut to the base body or the intermediate adapter piece if utilized, is guaranteed. However, the connection is one that is relatively easy to release when it is desired to change or invert the nozzle tip and such release can occur without the requirement of special tools.

In that embodiment which utilizes the intermediate adapter piece, it is advantageous to connect the adapter piece to the base body in a manner which will allow rotation of the adapter piece with respect to the base body. In such a construction the clamping nut is then attached to the adapter piece such that it is also rotatable with respect to the base body while remaining in secure clamped relationship to the adapter piece. One method of providing for such rotation is by means of a wire member received in part circular, opposed circumferential grooves in the opposed faces of the adapter piece and base body. This allows the clamping or cover nut to be rotated so as to rotate the nozzle member to provide for desired alignment of the spray pattern with the orientation of the spray gun such that the pattern of the spray may be changed without changing the orientation of the spray gun.

In a simplified embodiment of the invention, the adapter piece or base body is provided with an axially open, circumferentially closed recess for receipt of the nozzle mount. In a preferred embodiment, however, the clamping or cover nut and the transition piece, or the base body, are respectively provided with a radial passageway open to the nozzle mount recess. The nozzle mount is then inserted in a nozzle mount holder which projects through the radial opening to the exterior of the unit providing a grasping handle for the nozzle mount. By so doing, simply manipulation during the reversal of the nozzle is facilitated as well as the ability to assure proper alignment of the nozzle itself with the clamping nut, a feature which is particularly important when using nonconical nozzles.

The nozzle mount holder can expeditiously include a plurality of sleeve shaped recepticle parts which are each provided with a bore or the like for the receipt of the nozzle mount itself. Preferably, the interconnection between the nozzle mount and the nozzle mount holder recepticle includes provisions preventing rotation of the nozzle mount in the recepticle so as to allow proper alignment of the nozzle with respect to the nozzle mount holder. By use of a multi-recepticle nozzle mount holder, a single nozzle mount can be provided with a plurality of nozzles, the nozzle mount either being barbell shaped having nozzles at either ends, cross shaped having four ends or the like. Such a construction greatly facilitates exchange of nozzle tips.

In the preferred design a gasket or seal member is interposed between the spray gun outlet and the nozzle and is axially resilient. In this manner, a tight sealed flow path between the spray gun and the nozzle tip can be assured by tightly clamping down the clamping or cover nut and, moreover, a clamping between the gasket and the base body will also occur adding then resistance to rotation of the adapter piece.

It has further been found expediant to provide the end face of the gasket which faces the nozzle with a sealing edge which is formed by a conical opening in the direction of the nozzle providing a ring seal adjacent the outer diameter of the gasket. The sealing edge can rest directly against the nozzle tip or against a packing seal positioned intermediate the gasket and the nozzle tip partially interior of the nozzle mount bore thereby assuring sealing. Similarly, formation of a sealing ridge at the opposite end of the gasket has also been found expediant. The seal at the opposite end can ideally be provided by a T-shaped cross-section web extending outwardly from the gasket radially terminating in an increased axially thicker outer diameter portion which can be trapped or compressed between the base body and the end of the spray gun. By providing that the surfaces of the gasket facing the spray gun which can be contacted by the high pressure liquid from the spray gun exceed the area of the surfaces of the opposite end of the gasket which will be contacted by that liquid adjacent the nozzle, not only will an effective seal be provided but also an additional pressure force will be provided which will be transmitted to the individual parts of the overall tip housing in such a manner as to increase the clamping resistance to rotation of the clamping or cover nut. That is by forcing the gasket axially against the nozzle, and the nozzle therefor axially against the nozzle mount and the nozzle mount axially against the clamping or cover nut, the frictional resistance to rotation of the cover nut is increased at the engagement surfaces between the thread and detents.

In a further modification of the preferred embodiment, the central axial reach of the gasket which projects through the base body and/or the adapter piece may be provided with a metallic cover or coating which may be provided with one or more corners or planer surfaces mating with similar surfaces on the adapter piece to prevent relative rotation.

Moreover, the clamping or cover nut may be provided with projecting wings or barriers designed to function as a tip guard such that the spray stream emerging under high pressure from the nozzle will be shielded thereby diminishing the possibilities of injection accidents.

In order to economically manufacture the device, the coupling ring, the nozzle mount and the adapter piece can all be fabricated of synthetic resin as injected molded parts.

It is therefore an object of this invention to provide an improved nozzle assembly for spraying.

It is another, and more specific object of this invention to provide a nozzle assembly for spraying including a base mounting portion for attachment to a spray gun, a clamping nut for enclamping a nozzle mount between the base body portion and the clamping nut, and an interchangeable nozzle mount interposed between the base body and the clamping nut with the clamping nut being easily removable from the base body.

It is another specific object of this invention to provide a nozzle assembly for spraying systems which provides for ease of reversibility and exchangeability of nozzles, the assembly including a base body affixable to a spray gun, an intermediate adapter piece rotatably affixed to the base body having a recess therein for receipt of a nozzle mount at an axial end of the adapter piece, a gasket member spanning the distance between the spray gun and the nozzle mount interior of the adapter piece, and a quick removable clamping or cover nut entrapping the nozzle mount between the cover nut and the adapter piece.

It is another, and specific object of this invention to provide an improved spray tip assembly for spraying which allows easy echange and reversibility of spray nozzles which includes a base body affixable to the spray gun, an intermediate rotatable adapter piece and a quick on-clamping nut, the adapter piece providing a recepticle for receipt of a nozzle mount containing a nozzle, the nozzle mount affixed to a nozzle mount holder containing a plurality of nozzle mounts with different nozzles therein, each nozzle mount being reversible in the recess, a gasket member spanning the distance between the spray gun and the nozzle mount and the clamping member enclamping the nozzle mount in the recess engaging the gasket.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
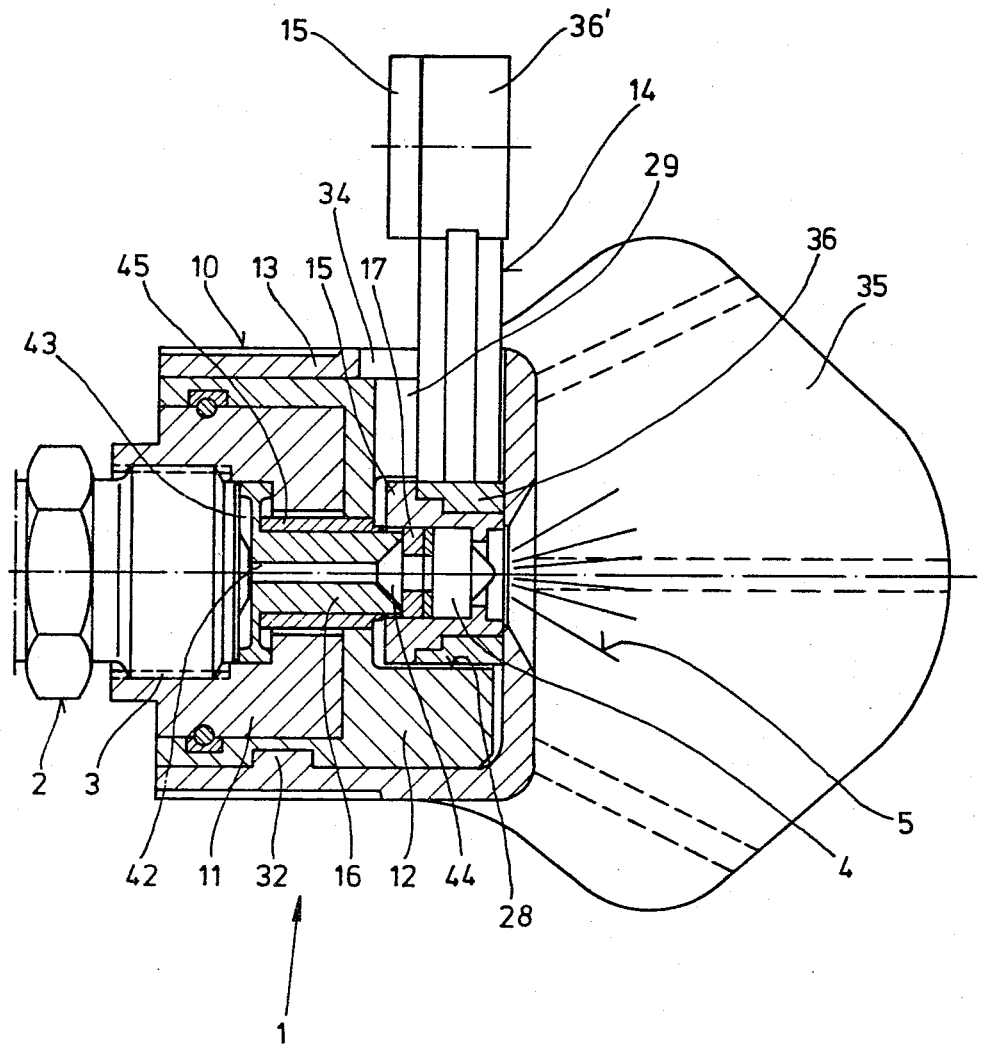
FIG. 1 is a cross-sectional view of a nozzle holder assembly according to this invention.

As best illustrated in FIG. 1, the nozzle holder assembly 1 of this invention is used to affix a nozzle tip 4 to an end 3 of a spray gun 2 through which a spray stream 5 can be generated. The device includes an overall housing 10 consisting of a base body or spray gun attachment member 11 threaded onto the end 3 of the spray gun, an intermediate adapter piece 12 rotatably secured to the base body and a clamping or cover nut 13 secured to the adapter piece.

It will be understood that although the description of the preferred embodiment includes the adapter piece, in other, and less preferred embodiments, the adapter piece may be eliminated and the cover or clamping nut connected directly to the base body.

The housing further encloses a gasket 16 which is trapped between the base body and end 3 of the spray gun and between the spray gun and a packing seal 17 received in a nozzle mount 15 which holds the nozzle 4.

Figure 2:
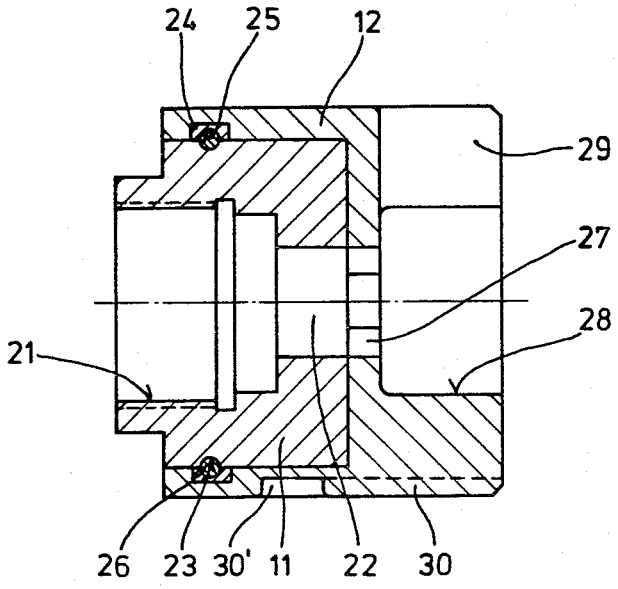
FIG. 2 is a cross-sectional view of the base body and adapter piece of this invention.
Figure 3:
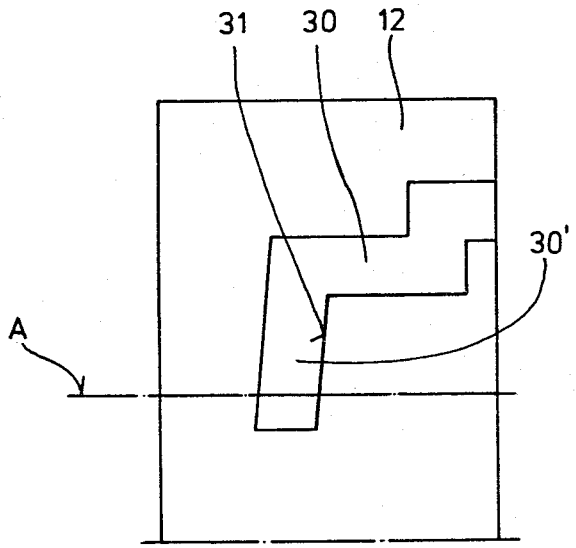
FIG. 3 is a planer illustration of a connector groove between the adapter piece and cover nut generated in the cylinder surface of the adapter piece.

As more clearly illustrated in FIG. 2, the base body 11 has a threaded bore 21 for attachment to the outside thread of the end 3 of the spray gun. The base body further has a central graduated bore 22 for receipt of the gasket 16. Additionally a groove 23 formed in the outer diameter of the base body is alignable with a groove 25 formed in the inner diameter of the adapter piece 12 which may be provided in an insert 24. A wire 26 can then be inserted between the two grooves thus effectively locking the adapter member axially on the base body while allowing relative rotation therebetween.

The adapter member includes a bore 27 aligned with the bore 22 and a recess 28 open to its axial end, the recess 28 adapted to receive a nozzle mount 15. The recess 28 also has a radial opening 29 to the outer circumference of the adapter member.

Figure 4:
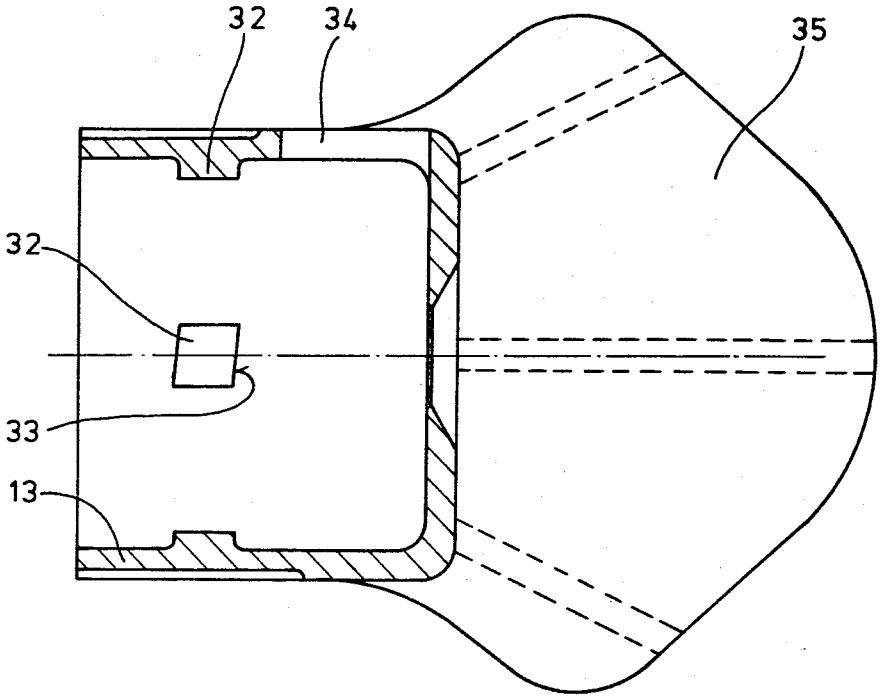
FIG. 4 is a cross-sectional view of the clamping nut of this invention.

For the purpose of securely affixing the clamping or cover nut 13, the adapter member may be provided with a plurality of thread grooves 30 which are interconnected in the manner of a chain of links disposed angularly with respect to one another to provide a quick latch thread. The groove 30 formed in the outer diameter of the adapter piece includes a final leg 30' which extends circumferentially and is inclined at an angle to a line normal to the axis of the adapter member. It is believed that a 5° angle will, in many instances, be sufficient. This angle provides a seating face 31 as a groove wall which can provide a secure seating when abutted by an equally inclined face 33 formed on an axial end of a radially inwardly projecting detent 32 formed in the inner diameter of the cover nut 13 as illustrated in FIG. 4. In this manner, the seating surfaces 31 and 33 provide a large area somewhat wedge-like contact surface to maintain the proper clamped relationship. The incline of the portion 30' also allows for progressive tightening of the clamping relationship.

As also illustrated in FIG. 4, the cover nut can be provided with projecting webs or wings 35 functioning as a tip guard. The cover nut has an axial open end adjacent the web 34 having a defined opening of a dimension less than the dimension less than the dimension of the nozzle mount 15 whereby the nozzle mount will be retained within the recess 28 by attachment of the clamping or cover nut 13.

As will be appreciated from a view of FIG. 1, the nozzle mount is formed as a holder for the nozzle or spray tip 4 and to that end is provided with an internal bore dimensioned to receive standard commercial nozzle tips, the bore having an inturned ledge spaced from its outlet end preventing axial movement of the nozzle tip. One or more seals or gasket members 17 may be provided interior of the bore locking the nozzle 4 in position.

Figure 5:
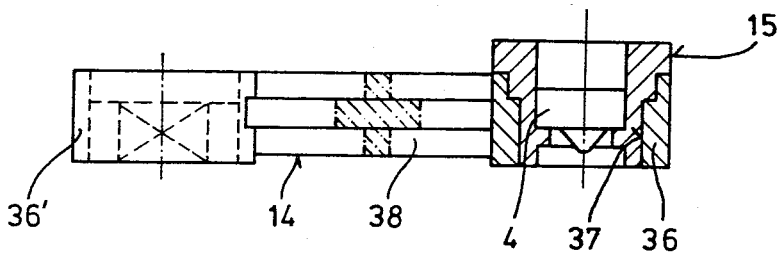
FIG. 5 is a partially sectional view of a nozzle mount holder and nozzle mount.

The nozzle holder, as illustrated, may have a stepped outer diameter interfitting with a stepped recess 36 of a nozzle mount holder 14. As shown in FIG. 5, the nozzle mount holder 14 may include two stepped recesses 36 and 36' at opposite ends of a central cross member 38. The individual nozzle mounts will then be securely received in the step bore 37 of the recepticles 36 and 36' and may, if desired, be more or less permanently affixed within the nozzle mount holder.

Figure 6:
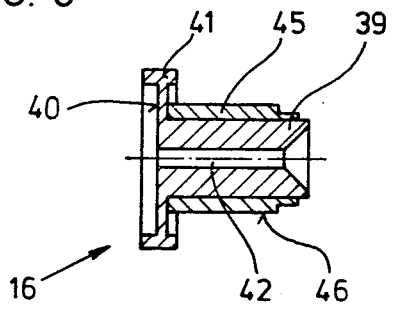
FIG. 6 is a cross-sectional view of a gasket or seal adapted to be interposed between the spray gun and the nozzle.

The gasket 16 as shown in FIG. 6, preferably includes an axially resilient member having a substantially cylindrical central body portion which may be stiffened by a metallic cover or cylinder 45. The outlet end is provided with a frustoconical opening to the central bore 42 and thereby defines a sealing edge or ring seal 39 for engagement with the nozzle 4 or gasket 17. The metallic cover or cylinder 45 may be provided with a non-cylindrical surface portion mating with a mating portion in the adapter piece to prevent relative rotation from occurring between the gasket and adapter piece.

The inlet end of the gasket is provided with a radially outwardly extending sealing web 40 terminating in a T-shaped cross bar 41 at its outer diameter, the cross bar having a dimension adapted to be received in a stepped portion of the bore 22 of the base body and to seal the area between the base body and spray gun end leaving an annular space open to receipt of high pressure material from the spray gun. Due to the resiliency of the material, the web will allow limited axial movement of the gasket under the presence of high pressure in the area 43 shown in FIG. 1. This will effectively urge the gasket axially in the direction of the spray flow into further engagement with the gasket 17 thereby adding to the lock up force maintaining the clamping or cover nut in proper tightened relationship with the adapter piece and further aiding in restraining rotation of the adapter piece with respect to the base body. It will be noted that the area 43 is of greater area than the opposed area 44 at the outlet end of the gasket insofar as application of axial pressure forces is concerned.

To provide for cleaning of the nozzle 4 it is only necessary that the clamping nut be rotated until the detents 32 no longer engage the section 30' of the groove 30. At this point the clamping nut will be loosened and the pressure fit created by the sealing surface 31 of the gasket against the nozzle mount released. At this point the nozzle mount can be axially moved a short distance to clear the gasket and the nozzle mount can therefore be removed by the holder 14 through the radial openings 39 and 34. It can be inserted then in 180° reverse direction and by a renewed rotation of the clamping nut can be reclamped in position for cleaning. By the same means, of course, the nozzle 4 can be exchanged for a different nozzle received in the holder portion 36' in order to exchange tips.

Since the nozzle 4 is held in a specific position within the nozzle mount, by means, for example, of a press fit, and since the nozzle mount 15 is likewise positioned with respect to the adapter piece due to the relative positions of the central web portion of the nozzle mount holder 14 and the openings 29 and 34, it can be easily assured that the opening of the nozzle 4 will always be precisely aligned with respect to the clamping nut and therefore the tip guard webs 35. Thus, flat section or oval spray tips are easily utilized in this construction without the possibility their being misaligned with respect to the tip guard. In order to further secure the nozzle mount and therefore the nozzle in proper position, the central web portion of the nozzle mount holder 14 may be provided with a configuration mating with a shaped surface of opening 29 and/or 30 which limits incorrect positioning of the nozzle mount.

Due to the rotation ability of the adapter piece with respect to the base body, whenever the clamping nut is loosened, a desired angular relationship between the spray gun and the spray pattern is easily effectuated. This angular relationship, once determined by rotation of the adapter piece on the base body, will be maintained due to the forces created when the clamping nut is tightened on the adapter piece and the resulting pressures preventing rotation whic occur between the nozzle mount and gasket, with the gasket being firmly affixed against rotation in the adapter piece.

It can therefore be seen that this device has great versatility and allows easy reversability of the nozzle tip or exchange of nozzle tips by the simple expedient of a slight rotation of the clamping or cover nut which rotation also frees up the system to allow the adapter piece to be rotated to change spray orientation if desired. By proper dimensioning of the various pieces, including the portion 38 of the nozzle mount holder and the openings 34 in the clamping nut and 29 in the adapter piece, it can be assured that proper alignment of the spray will always be maintained.

Although the teachings of my invention have herein been discussed with reference to specific theories and embodiments, it is to be understood that these are by way of illustration only and that others may wish to utilize my invention in different designs or applications.

We claim as our invention:

1. A nozzle assembly for spray guns comprising a cylindrical base body assembly having an internally threaded bore for attachment to the outlet end of a spray gun, the base body assembly having an axial recess therein at an end opposite the threaded bore and open thereto, a nozzle mount received in said recess, a nozzle received in said nozzle mount, a cover nut having an axial end wall with an outlet orifice therethrough, the outlet orifice having an opening larger than the maximum dimension of a spray stream from the nozzle when the cover nut is affixed to the base body assembly in operative position and said opening being less than the maximum dimension of the nozzle mount, the cover nut receivable on the base body assembly, a quick thread connection between the cover nut and base body assembly, the thread connection providing first and second rotational positions of the cover nut with respect to the base body assembly, the cover nut end wall enclamping the nozzle mount between the base body assembly and cover nut axial end when the cover nut is in the first position with respect to the base body assembly, the nozzle mount freely removable from the recess when the cover nut is in the second position with respect to the base body assembly, aligned radial openings on the base body assembly and cover nut communicating to said recess, a projection on said nozzle mount projecting through said openings and the opening on the cover nut having a circumferential dimension to allow rotation of the cover nut between the first and second positions without interference with the projection.

2. The device of claim 1 including seal means between the threaded bore of the base and the nozzle defining a sealed space for flow of fluid from the threaded bore to the nozzle.

3. The device of claim 2 wherein the seal means is axially resilient and is provided with an axial end seal for operatively sealing at the nozzle mount and for providing an axial force at the nozzle mount urging the nozzle mount into contact with the axial end of the cover nut.

4. The device of claim 3 wherein the base body further comprises a plurality of members including an adapter member rotatably carried on a spray gun attachment member, and wherein the threaded bore is formed in the spray gun attachment member and the nozzle mount recess is formed in the adapter member.

5. The device of claim 4 wherein the seal means has circumferential outer surface means engaging inner diameter surface means of the adapter member and preventing relative rotation between the seal means and adapter piece.

6. A tip assembly for spray guns comprising: a base body having a stepped bore extending therethrough from a first axial end to a second axial end, the stepped bore having a first threaded portion open to the first axial end for threaded engagement with a spray gun, an intermediate stepped portion of said bore adjacent said threaded section, a sealing member having a bore therethrough having a first axial end of larger diameter and a second axial end of reduced diameter, the large diameter end received in the intermediate stepped portion of the bore, an adapter member rotatably carried by said base body having a portion extending beyond the second axial end and having a bore therethrough aligned with the stepped bore, the sealing member extending through the bore of the adapter member, the sealing member and bore of the adapted member having opposed contacting antirotational surfaces, the adapter member having a recess open to the bore at an axial end of the adapter member remote from the base body, a nozzle mount received in said recess and being removable from said recess and insertable in said recess in a reverse position, a central bore in the nozzle mount alignable with the bore of the sealing member, a nozzle tip in the central bore of the nozzle mount, the sealing member including seal means for sealing between the nozzle mount and sealing member, the sealing member being axially resilient and effective, when compressed, to urge the nozzle mount away from the spray gun, a cover nut for said assembly having an axial end wall with an orifice therethrough having an opening less than a maximum dimension of the nozzle mount, the opening alignable with the recess, the cover nut having a quick thread connection with the adapter member whereby the cover nut can be attached to the adapter member with the axial end of the cover nut engaging the nozzle mount, the quick connect allowing relative axial movement between the adapter piece and the cover nut for axially urging the nozzle mount against the sealing member.

7. A device according to claim 6 wherein the nozzle mount is carried in a nozzle mount holder having a portion extending substantially normal to the axis of the nozzle mount, the recess having radial opening thereto open to a periphery of the adapter member, the cover nut having an opening therethrough alignable with the radial opening of the adapter member, the nozzle mount holder insertable through the radial openings to position a nozzle mount in the recess and being removable therefrom to remove the nozzle mount from the recess.

8. A device according to claim 7 wherein the nozzle mount holder carries a plurality of nozzle mounts.

9. A device for attaching the nozzle of a spray gun to the spray gun in one of two different directions which are 180° reversed from one another, comprising a base body assembly adapted to be rigidly connected to the outlet end of a spray gun, a clamping nut adapted to be locked onto the base body assembly, the base body assembly provided with a recess at an axial end facing away from the spray gun, said recess being open to the axial end face of the base body member, the clamping nut effective to close a peripheral portion of the recess, a nozzle mount having a nozzle affixed therein, the nozzle mount receivable in the recess and retained therein by the clamping nut, and a seal member disposed between the nozzle and the spray gun extending through said base body assembly, said seal in operative axial engagement with the nozzle mount and means hydraulically biasing the seal against the nozzle mount, and means for removing the nozzle mount from the recess without disassembly of the base body assembly and clamping nut connection.

10. A device according to claim 9 wherein the base body assembly and clamping nut are respectively provided with one of a plurality of projecting detents and recessed quick thread grooves, said dentents dimensioned to be received in said grooves, said grooves including a clamping position portion disposed at an angle to the axis of the base body and clamping nut.

11. A device according to claim 10 wherein the clamping position portion has an abutment surface mating with an abutment surface on the detents, the surfaces lying at an angle to the axis which is substantially self-locking.

12. A device according to claim 9 wherein the seal member is axially resilient.

13. A device according to claim 12 wherein the seal member has opposed axial ends, one of said ends having an increased diameter providing an axial end surface circumferentially around a central bore extending through the seal member, said one end being positioned adjacent the spray gun, the seal member having a second end opposite the one end having an axial seal formed thereon, the axial seal operatively sealing at the nozzle, the one end having a large area open to the pressure of liquid being dispensed by said spray gun effective to bias the seal away from the spray gun and into sealing engagement with the nozzle, the second end having an axial area exposed to the fluid being sprayed less than the area of the one end.

14. A device according to claim 13 wherein means are provided preventing relative rotation of the seal member and the base body.

15. A device for attaching the nozzle of a spray gun to the spray gun in one of two different directions which are 180° reversed from one another, comprising a base body adapted to be rigidly connected to the outlet end of a spray gun, an adapter member rotatably carried by the base body, said adapter member having a recess therein at an axial end remote from the spray gun, said recess being axially opened to the axial end, a clamping nut, said clamping nut adapted to be locked onto the adapter member, said clamping nut having an axial end face blocking a peripheral portion of the recess, a nozzle mount having a nozzle affixed in a bore through the nozzle mount, receivable in said recess in each of two different positions 180° reversed from one another and being retained in the recess by the clamping nut, and removable from the recess upon loosening of the clamping nut and a seal member disposed between the nozzle and the spray gun extending through the adapter member and base body and having an end portion projecting into the bore through the nozzle mount.

16. A device according to claim 15 wherein the adapter member and clamping nut are respectively provided with one of a plurality of projecting detents and recessed quick thread grooves, said detents dimensioned to be received in said grooves, said grooves including a clamping position portion disposed at an angle to the axis of the adapter member and clamping nut.

17. A device according to claim 16 wherein the clamping position portion has an abutment surface mating with an abutment surface on the detents, the surfaces lying at an angle to the axis which is substantially self-locking.

18. A device according to claim 15 wherein the adapter member is rotatably affixed to the base body by means of a wire member received in opposed hemispherical circumferential grooves in the adapter member and base body.

19. A device according to claim 15 wherein the seal member is axially resilient.

20. A device according to claim 19 wherein the seal member has opposed axial ends, one of said ends having an increased diameter providng an axial end surface circumferentially around a central bore extending through the seal member, said one end being positioned adjacent the spray gun, the seal member having a second end opposite the one end having an axial seal formed thereon, the axial seal operatively sealing the nozzle, the one end having a large area open to the pressure of liquid being dispensed by said spray gun effective to bias the seal away from the spray gun and into sealing engagement with the nozzle, the second end having an axial area exposed to the fluid being sprayed less than the area of the one end.

21. A device according to claim 20 wherein means are provided preventing relative rotation between the seal member and the adapter member.

22. A device for attaching the nozzle of a spray gun to the spray gun in one of two different directions which are 180° from one another, comprising a base body assembly adapted to be rigidly connected to the outlet end of a spray gun, a clamping nut adapted to be locked onto the base body assembly, the base body assembly provided with a recess at an axial end facing away from the spray gun, said recess being open to the axial end face of the base body assembly, the clamping nut effective to close a peripheral portion of the recess, a nozzle mount having a nozzle affixed therein, the nozzle mount receivable in the recess and retained therein by the clamping nut, and a seal member disposed between the nozzle and the spray gun extending through said base body wherein the base body and clamping nut are respectively provided with radial openings open to the recess for insertion and removal of the nozzle mount.

23. A device according to claim 22 wherein the nozzle mount is received in a nozzle mount holder insertable through the radial openings.

24. A device according to claim 23 wherein the nozzle mount holder includes a plurality of recepticles for receipt of nozzle mounts with a handle portion interconnecting the recepticles, and means are provided for proper positioning of the recepticles in the recess.

25. A device for attaching the nozzle of a spray gun to the spray gun in one of two different directions which are 180° reversed from one another, comprising a base body adapted to be rigidly connected to the outlet end of a spray gun, an adapter member rotatably carried by the base body, said adapted member having a recess therein at an axial end remote from the spray gun, said recess being axially opened to the axial end, a clamping nut, said clamping nut adapted to be locked onto the adapter member, said clamping nut having an axial end face blocking a peripheral portion of the recess, a nozzle mount having a nozzle affixed therein receivable in said recess in each of two different positions 180° reversed from one another and being retained in the recess by the clamping nut, and a seal member disposed between the nozzle and the spray gun extending through the adapter member and base body wherein the adapter member and clamping nut are respectively provided with radial openings open to the recess for insertion and removal of the nozzle mount.

26. A device according to claim 25 wherein the nozzle mount is received in a nozzle mount holder insertable through the radial openings.

27. A device according to claim 26 wherein the nozzle mount holder includes a plurality of recepticles for receipt of nozzle mounts with a handle portion interconnecting the recepticles, and means are provided for proper positioning of the recepticles in the recess.

* * * * *